US007749599B2

(12) United States Patent
Kawaguchi et al.

(10) Patent No.: US 7,749,599 B2
(45) Date of Patent: Jul. 6, 2010

(54) CUSHIONING MATERIAL FOR A POLISHING PAD

(75) Inventors: Hiromasa Kawaguchi, Komagane (JP); Toshiaki Kimura, Komagane (JP); Takeshi Kawakami, Komagane (JP)

(73) Assignee: NHK Spring Co., Ltd., Kanagawa (JP)

( * ) Notice: Subject to any disclaimer, the term of this patent is extended or adjusted under 35 U.S.C. 154(b) by 150 days.

(21) Appl. No.: 11/815,900

(22) PCT Filed: Feb. 10, 2006

(86) PCT No.: PCT/JP2006/302355

§ 371 (c)(1),
(2), (4) Date: Aug. 9, 2007

(87) PCT Pub. No.: WO2006/085614

PCT Pub. Date: Aug. 17, 2006

(65) Prior Publication Data

US 2009/0011221 A1 Jan. 8, 2009

(30) Foreign Application Priority Data

Feb. 14, 2005 (JP) ..... 2005-035818

(51) Int. Cl.
*B32B 27/08* (2006.01)
*B32B 5/20* (2006.01)

(52) U.S. Cl. ..... 428/319.3; 428/318.8; 428/319.7; 521/170

(58) Field of Classification Search ..... 428/318.8, 428/319.3, 319.7; 521/170
See application file for complete search history.

(56) References Cited

U.S. PATENT DOCUMENTS

| | | | | |
|---|---|---|---|---|
| 4,264,743 | A * | 4/1981 | Maruyama et al. | 521/101 |
| 6,237,717 | B1 * | 5/2001 | Osanai et al. | 181/294 |
| 2005/0248102 | A1 * | 11/2005 | Sato | 277/650 |
| 2005/0282989 | A1 * | 12/2005 | Rosthauser | 528/44 |
| 2006/0213608 | A1 * | 9/2006 | Moineau et al. | 156/246 |

FOREIGN PATENT DOCUMENTS

| | | | |
|---|---|---|---|
| FR | 2858328 | A1 * | 2/2005 |
| JP | 11-156701 | | 6/1999 |
| JP | 2004-253764 | | 9/2004 |

* cited by examiner

*Primary Examiner*—Hai Vo
(74) *Attorney, Agent, or Firm*—McGlew and Tuttle, P.C.

(57) ABSTRACT

Disclosed is a cushioning material for a polishing pad, which hardly suffers swelling deformation caused by water because it is extremely low in water-absorbing characteristics and water-swelling characteristics. The cushioning material for a polishing pad includes a polyurethane foam capable of polishing even a semiconductor wafer having an undulated surface or a wafer having a local step that is formed during circuit forming process so that the undulation or step becomes smaller by uniformly polishing an entire surface of the wafer along the undulation or step. The cushioning material for a polishing pad is characterized by including a polyurethane foam obtained by reacting polyol and polyisocyanate with each other, the polyurethane foam having a contact angle with water of 90° or more. The polyurethane foam is preferably made by using hydrophobic polyol, and preferably has a self-skin layer formed thereon.

4 Claims, 1 Drawing Sheet

CUSHIONING MATERIAL FOR A POLISHING PAD

BACKGROUND OF THE INVENTION

1. Field of the Invention

The present invention relates to a cushioning material for a polishing pad, used for flattening a semiconductor wafer or a wafer during a circuit forming process, and more particularly, to a cushioning material for a polishing pad, realizing uniform flattening polishing of an entire wafer with high accuracy.

2. Description of the Related Art

A semiconductor wafer is flattened by being chemical-mechanically polished in a method called a chemical mechanical polishing method (hereinafter, abbreviated as CPM method). A polishing device adopting the CPM method employs a polishing pad. The polishing pad includes a surface layer (upper layer) and a lower layer. The surface layer is formed of a hard material (hereinafter, referred to as surface layer material) and the lower layer is formed of a cushioning material (soft material).

Conventionally, for the cushioning material of the polishing pad, a polyurethane foam is widely used. However, the cushioning material made of the polyurethane foam has air permeability, so the cushioning material absorbs slurry water used for polishing to be swollen during polishing process. As a result, "permanent set" is caused partially or entirely in the cushioning material, or elasticity thereof is changed. The polishing pad has a structure in which a surface layer material and the cushioning material are formed integrally with each other. Therefore, advancement in swelling deformation of the cushioning material affects the surface layer material, thereby disabling uniform polishing with accuracy. Thus, there arises a problem of replacement frequency for the polishing pad becoming higher.

In this case, in a conventional technique, in order to solve the above-mentioned problem, there are proposed a material including a flexible film made of polyethylene or the like, serving as a waterproof material layer interposed between the surface layer material and the cushioning material (see, for example, JP 11-156701 A (claim 1, 0016)), and a cushioning material including a polyurethane foam with small variation in thickness obtained by using a silicone foam stabilizing material having a functional group, thereby reducing a water vapor permeability to adjust foaming density and hardness, the polyurethane foam having adhesive layers on both surfaces thereof (see, for example, JP 2004-253764 A (claim 1, 0008)).

However, with the structure in which the waterproof material layer is interposed between the surface layer material and the cushioning material, there is a risk of work-hour being increased for sticking the waterproof material (film) and, because the waterproof material is the film, a wrinkle being caused at a time of sticking the film. There is a problem in that, due to the wrinkle on the film, uniformity of the thickness of the pad is impaired, costs increase, or the like. Further, even when the waterproof material layer is provided between the surface layer material and the cushioning material, intrusion of water from a side surface of the cushioning material cannot be prevented, so the structure is imperfect.

Further, the structure in which the adhesive layers are provided to the both surfaces is imperfect for preventing intrusion of water in a state where, even if the cushioning material itself has low moisture absorption, the cushioning material repeats compression and restoration.

SUMMARY OF THE INVENTION

The present invention has been proposed in view of the above-mentioned points, and it is therefore an object of the present invention to provide a cushioning material including a polyurethane foam capable of polishing even a semiconductor wafer having an undulated surface or a wafer having a local step that is formed during a circuit forming process so that the undulation or step becomes smaller by uniformly polishing an entire surface of the wafer along the undulation or step.

Specifically, an object of the present invention is to provide a cushioning material for a polishing pad in which a cushioning material suppresses intrusion of slurry water for polishing to an extremely small degree, thereby hardly suffering swelling deformation caused by water. Further, an object of the present invention is to provide a cushioning material including a polyurethane foam, having a wide restoration elastic region in an initial compression state and an excellent stress dispersibility, which is suitable for such polishing that the undulation or irregularity on a surface of the semiconductor wafer becomes smaller to obtain the uniform surface. That is, an object of the present invention is to provide a cushioning material for a polishing pad, which is water repellent and highly efficient, and has improved water absorbing characteristics and swelling characteristics which are problems with the conventional cushioning material for a polishing pad.

In order to solve the above-mentioned problems, there is provided a cushioning material for a polishing pad, characterized by including a polyurethane foam having a contact angle with water of 90° or more, which is obtained by reacting polyol and polyisocyanate with each other.

The polyurethane foam having the contact angle with water of 90° or more has high water repellency, and water absorption ratio and water-swelling characteristics are degraded. Further, the polyurethane foam obtained by reacting polyol and polyisocyanate with each other exhibits restoration characteristics superior in stress dispersibility at the time of initial compression of the cushioning material and functions to make the undulation or irregularity on the surface of the semiconductor wafer at the time of polishing be smaller to obtain the smooth and uniform surface.

Further, the cushioning material for a polishing pad according to the present invention is characterized by including a polyurethane foam obtained by using hydrophobic polyol. Preferable as the hydrophobic polyol is dimer acid polyester polyol.

With this structure, water repellency is imparted to the polyurethane foam.

Further, a cushioning material for a polishing pad is characterized in that the polyurethane foam has a self-skin layer formed thereon. With the formation of the self-skin layer, smoothness increases, a water absorption ratio decreases, and adhesion performance to an adhesive tape or the like is improved.

Further, a cushioning material for a polishing pad is characterized in that the polyurethane foam is formed by being integrated with a PET film and has the PET film on a surface thereof.

With this structure, an exposed surface area in the cushioning material for a polishing pad is reduced, and the water absorption property is deteriorated. Further, it is possible to prevent unnecessary expansion and contraction of the polyurethane foam, thereby increasing strength thereof.

According to the cushioning material for a polishing pad of the present invention, the following effects can be obtained.

(1) The cushioning material has high water repellency, low water absorption property, and low water-swelling characteristics, in which aged deterioration of mechanical properties does not occur for a long time, thereby enabling stable polishing with high accuracy for a long time. Accordingly, replacement frequency of the polishing pad (two-layer structure formed of surface layer material and cushioning material) is drastically reduced.

(2) The cushioning material includes the polyurethane foam having the restoration characteristics superior in stress dispersibility at the time of initial compression of the cushioning material, so it is possible to perform such polishing that undulation or irregularity on the surface of the semiconductor wafer at the time of polishing becomes smaller to obtain the smooth and uniform surface.

DETAILED DESCRIPTION OF THE PREFERRED EMBODIMENTS

Figure 1:
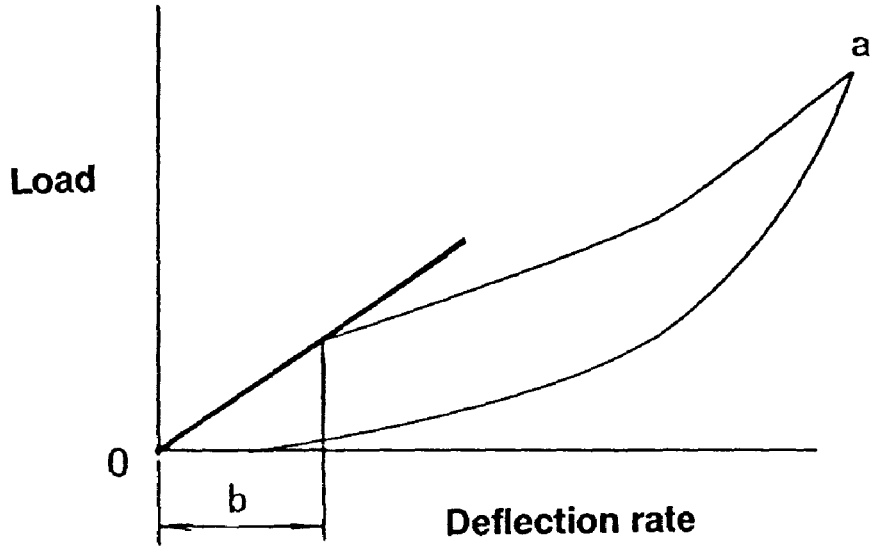
FIG. 1 is a graph showing a load-deflection curve at a time of measuring a compression hardness for describing a restoration elasticity.

Hereinafter, the present invention will be described in detail.

A cushioning material for a polishing pad according to the present invention includes a polyurethane foam obtained by reacting polyol and polyisocyanate with each other and having a contact angle with water of 90° or more. The polyurethane foam obtained by reacting polyol and polyisocyanate with each other exhibits restoration characteristics superior in stress dispersibility at a time of initial compression of the cushioning material and makes undulation or irregularity on a surface of a semiconductor wafer at a time of polishing be smaller to obtain the smooth and uniform surface. Further, the polyurethane foam having the contact angle with water of 90° or more has high water repellency, water absorption property and water-swelling characteristics thereof can be suppressed, and aged deterioration of mechanical properties at the time of polishing can be maintained small for a long period of time. Use of hydrophobic polyol as the polyol enables the polyurethane foam to be imparted with the water repellency, which is preferable. Further, it is preferable that the polyurethane foam be formed with a self-skin layer because smoothness increases, a water absorption ratio decreases, and adhesion to an adhesive tape or the like is improved. Further, the polyurethane foam may integrally be molded with a PET film. With this structure, the polyurethane foam has the PET film on a surface thereof, so an exposed surface area is reduced by an amount corresponding thereto. As a result, water absorption property is deteriorated, and unnecessary expansion and contraction of the polyurethane foam can be prevented, thereby increasing strength of the polyurethane foam.

In this case, to a curing composition of the polyurethane foam, in addition to later-described hydrophobic polyol and conventionally known multifunctional polyisocyanate, additives such as a foam stabilizing material, a curing catalyst, a foaming agent, a crosslinking agent, a coloring agent, a resin modifying material, a flame retardant, an ultraviolet absorbing agent, and a durability improving agent can be added within a range without impairing the object of the present invention, but the present invention is not limited thereto.

The hydrophobic polyol passes a compatibility test for the polyol which will be described later. Specifically, examples of dimer acid type polyol include an esterified product of dimer acid and hydroxide such as ethylene glycol, diethylene glycol, trimethylolpropane, glycelin, or the like, caster oil, modified caster oil, polybutadiene-based polyol and a hydrogenated product thereof, polyisoprene-based polyol and a hydrogenated product thereof, and a mixture of those. However, the dimer acid type polyol is not limited to those. For example, the above-mentioned examples of polyol are used for an OH group terminal prepolymer or NCO group terminal prepolymer reacted with a later-described multifunctional isocyanate in advance. However, this is not obligatory.

In a compatibility test method for polyol, 2 g of a sample is weighed in a glass test tube having a diameter of about 18 mm and a length of 180 mm, a solution prepared so as to have isopropyl alcohol and distilled water at a weight ratio of 75 to 25 is dropped by a burette. When the resultant liquid is gradually turned cloudy and a line at 0.5 mm becomes invisible through the test tube, in a case where an added amount of the solution at this time is equal to or less than 2 g, the sample is judged to pass the test. Note that, this test is performed at a liquid temperature of 25°.

Examples of the multifunctional isocyanate include an aromatic polyisocyanate and aliphatic polyisocyanate at least two of which are included by an isocyanate group in a molecule, or a modified product of those. Specifically, examples of the multifunctional isocyanate include toluene diisocyanate (TDI), diphenylmethane diisocyanate (MDI), isophorone diisocyanate (IPDAI), hexamethylene diisocyanate (HMDI), tetramethylene diisocyanate (HDI), tetramethylxylylene diisocyanate (TMXDI), and a mixture of those. However, the multifunctional isocyanate is not limited to those.

Examples of the foam stabilizing agent include an organic silicone foam stabilizing agent, surfactant, and a mixture of those. It is preferable that the former be not used depending on a purpose. However, when the former is used, it is preferable to use a silicone foam stabilizing agent having an active group such as a hydroxy group and an amino group reacting with the multifunctional isocyanate because the silicone foam stabilizing agent does not transfer when this silicone foam stabilizing agent is used. On the other hand, examples of the latter include diethylamino oleate, sorbitan monostearate, glycerin mono-oleate, vinyl pyrrolidone, fluorines, organic compounds, and a mixture of those. However, the surfactant is not limited to those.

The above-mentioned compound is used by being added in an amount as small as possible because it is desired for the cushioning material for a polishing pad not to be transferred, and it is more preferable that the above-mentioned compound be not used.

Examples of the foaming agent include water, an inert gas such as nitrogen, carbon dioxide, and air which are gaseous under a normal pressure, halogenated alkane such as mono fluorinated methane trichloride and methane dichloride, low-boiling alkane such as butane and pentane, azobisisobutylnitrile generating a decomposed nitrogen gas or the like, and a mixture of those. However, the foaming agent is not limited to those.

As other additives, any of a catalyst, a crosslinking agent, a coloring agent, a resin modifying agent, a flame retardant, an ultraviolet absorbing agent, a durability improving agent, and the like can be used as needed.

The polyurethane foam as the cushioning material according to the present invention is manufactured by using the above-mentioned materials through a conventionally known process such as a one-shot process or a partial prepolymer process. When the polyurethane foam to be manufactured is formed in a sheet shape by mold forming, continuous sheet forming, or the like, the polyurethane foam is suitable for the cushioning material for a polishing pad, which is preferable. Further, the polyurethane foam may be formed in the sheet shape and have the self-skin layer formed by the mold forming, the continuous sheet forming, or the like.

The cushioning material for the polishing pad is used by being normally adjusted to have a thickness of 0.5 to 2 mm, a density of 300 to 700 kg/m$^3$, a 25% compression residual strain of 10% or less, a 25% compression stress of 0.3 to 0.7 MPa. Therefore, the polyurethane foam as the cushioning material according to the present invention is also arbitrarily adjusted to fall within the above-mentioned ranges by using the materials described above.

Next, the present invention will be described in detail by way of examples and comparative examples. Herein, part and % are determined based on weight. A foam obtained as a curing composition of a polyurethane foam according to the examples and the comparative examples is prepared by the following method. That is, a reaction material obtained by mixing and stirring hydrophobic polyol, polyisocyanate, a catalyst, and a blend including the other additives was uniformly applied by using an application bar to a removal surface of process paper such as a PET film which is subjected to a removal treatment, and after that, the reaction material was covered with another process paper so that the process paper was also provided so as to have a removal treatment surface thereof facing an upper surface of the reaction material, and the resultant was then allowed to be foamed and cured in a heated oven (three minutes at 70° C. and four minutes at 120° C.), thereby obtaining the polyurethane foam in a sheet shape formed with a self-skin. For the preparation of a polyurethane foam integrated with a PET film, there was used, as process paper covering the upper surface in the above-mentioned method, a PET film which is not subjected to the removal treatment. For performance evaluation described later, the polyurethane foam aged for three days at normal temperature was used as a specimen to be measured.

Example 1

100 parts of dimer acid polyester polyol (average molecular amount of 1400, hydroxyl value of 80) obtained by reacting dimer acid and DEG with each other, 0.1 parts of water, and 0.2 parts of an amine catalyst (SA 102 manufactured by SAN-ABOT LTD.) were steered well. The resultant mixture was added with a carbodiimide-modified MDI (hereinafter, abbreviated as MDI, NCO 29.5%) such that an NCO/OH ratio is 1.05, and was steered forthwith. The resultant was uniformly applied to a PET film which has been subjected to the removal processing, thereby obtaining a polyurethane foam of a sheet shape having a thickness of 1.2 mm and a density of 55 kg/m$^3$.

Example 2

A polyurethane foam of a sheet shape was obtained in the same manner as that of Example 1 except that 0.05 parts of water serving as a foaming agent was added.

Comparative Example 1

A polyurethane foam of a sheet shape was obtained in the same manner as that of Example 1 except that, in place of dimer acid polyester polyol obtained by reacting the dimer acid and DEG according to Example 1, there was used polyether polyol (average molecular amount of 3000, hydroxyl value of 57) obtained by adding Po/Eo to glycerin.

Comparative Example 2

A polyurethane foam of a sheet shape was obtained in the same manner as that of Example 1 except that, in place of the carbodiimide-modified MDI, there was used a diol-urethane-modified MDI (NCO %).

Comparative Example 3

A polyurethane foam of a sheet shape was obtained in the same manner as that of Example 1 except that 0.3 parts of water serving as a foaming agent were added and 20 parts of aluminum hydroxide serving as flame retardant were added.

Next, with regard to the polyurethane foam obtained in each of the examples and the comparative examples, a performance evaluation test was performed for items such as a contact angle with water, a density, a compression hardness, a restoration elasticity, a 25% compression residual strain, a water absorption ratio, and a water-swelling ratio. A test method is described in an item (1), and performance evaluation contents obtained as the test results are described in an item (2).

Contact Angle with Water (1) A specimen was sandwiched between aluminum foils and was pressed at a temperature of 180° C. to 200° C. and a pressure of 40 to 50 kg/cm$^2$ to be formed in a film shape, and the aluminum foil was then removed. A water droplet was dropped on a surface of the resultant. A contact angle with water is a value obtained by measuring with a contact angle meter a contact angle at which a specimen and a water droplet come into contact with each other. As the contact angle meter, a Kyowa contact angle meter (CA-A manufactured by Kyowa Interface Science Co., LTD.) was used.

(2) When the contact angle is equal to or more than 90°, water repellency is imparted, so the water absorption ratio and the water-swelling ratio become lower. In order to impart the water repellency, the hydrophobic polyol is used. A polyurethane foam obtained with a reactive silicone foam stabilizing agent has higher water repellency, and suppresses bleeding out of silicone, thereby increasing an adhesion force with an adhesive agent. In order to impart hydrophobic characteristics, a petroleum resin, oil, or the like can be added. In this case, an amount of the addition has to be maintained as small as possible in order to prevent adhesion to a semiconductor wafer.

Density (1) A density was measured by following JISK6400. The specimen was punched out to have a size of 100 mm by 100 mm, and thicknesses of nine portions of the specimen were then measured (n=2).

(2) The density affecting characteristics of the polyurethane foam can be adjusted according to amounts of water serving as the foaming agent and an organic foaming agent. There is a close relationship between the density and the compression hardness. When the density is high, a value of the compression hardness is large.

Compression Hardness (1) A specimen was placed on a center of a universal testing machine having an automatic recording device and capable of maintaining a compression rate constant. In each of the examples and the comparative examples, a load was read, which is obtained when the specimen was compressed to a 25% thickness of an original thickness of the specimen. The compression rate was 50 mm/min.

(2) The compression hardness largely depends on the density. The compression hardness is also affected by the number f of the functional groups of polyol and polyisocyanate. When the number f is large, the value of the compression hardness is large.

Normally, there is used a cushioning material for a polishing pad having a density of 300 to 700 kg/m$^3$ and a 25% compression stress of 0.3 to 0.7 MPa. Accordingly, the above-mentioned density and compression hardness preferably fall within those ranges.

Restoration Elasticity (1) As shown in FIG. 1, from the load-deflection curve at the time of measuring the compression hardness, a deflection rate at which linearity could be obtained was determined. The larger value of the deflection rate (restoration elasticity) was preferable.

(2) When the restoration elasticity at the initial compression is higher, the stress dispersibility becomes higher. Therefore, the undulation, irregularity, step, or the like of the cushioning material is made smaller, thus the cushioning material is suitable for the cushioning material for a polishing pad.

of a ratio (wt %) with respect to an original weight. The specimen having a size of thickness by 100 mm by 100 mm was immersed in water without being compressed, and the test was performed in an oven of 50° C.

(2) The higher the water repellency is, the smaller a value of the water absorption ratio is. When there is an isolated cell, the water absorption ratio of a small value is exhibited.

Water-Swelling Ratio (1) At a water pressure of 10 cm and in an atmosphere of 50° C., a thickness of the specimen sample after 24 hours was measured, and an increase in thickness was indicated in a form of a ratio (%) with respect to an original thickness. The specimen having a size of thickness by 100 mm by 100 mm was immersed in water without being compressed, and the test was conducted in an oven of 50° C.

(2) The lower the water absorption ratio and the higher the water repellency are, the smaller the value of the water-swelling ratio is exhibited.

Next, results of the test for the polyurethane foam according to the examples and the comparative examples are shown in Table 1.

TABLE 1

| | Unit | Example 1 | Example 2 | Comparative Example 1 | Comparative Example 2 | Comparative Example 3 |
|---|---|---|---|---|---|---|
| Polyol | — | A | A | B | C | D |
| Thickness of foam | mm | 1.2 | 0.7 | 1.8 | 0.7 | 2.7 |
| Contact angle θ | ° | 98 | 98 | 86 | 84 | 81 |
| Density of foam | kg/m$^3$ | 450 | 590 | 610 | 514 | 349 |
| 25% compression hardness | MPa | 0.49 | 0.68 | 0.47 | 0.29 | 0.20 |
| 25% compression residual strain | % | 1.1 | 1.4 | 5.7 | 0.4 | 0.8 |
| Water absorption ratio (foam) | wt % | 1.0 | 0.9 | 10 | 39 | 52 |
| Water absorption ratio (integrated with PET) | wt % | 0.4 | 0.3 | 1.1 | 3.2 | 5.5 |
| Water-swelling ratio (thickness) | % | 0.2 | 0.1 | 0.6 | 0.7 | 0.9 |
| Restoration elasticity | % | 2.5 | 2.8 | 1.8 | 2.6 | 1.6 |

Polyol/MDI type
A: Dimer acid polyester polyol/MDI
B: Polyether polyol/MDI obtained by adding Po/Eo to glycerin
C: Polyether polyol/Urethane (diol)-modified MDI obtained by adding Po/Eo to glycerin
D: Polyether polyol which contains aluminum hydroxide/MDI, obtained by adding Po/Eo to glycerin 25% Compression Residual Strain (1) Two flat compression metal plates which were not easily deformed were used in parallel to each other to compress and fix the specimen in position to have a 75% thickness of the original thickness of the specimen, and retained the specimen at a temperature of 21° C. to 25° C. for 24 hours. After 24 hours, the specimen was taken out from the compression plates and were left for 30 minutes as it was, and a thickness thereof was then measured.

$$\text{Compression residual strain}=(\text{thickness before test}-\text{thickness after test})/\text{thickness before test}\times 100$$

(2) When a value of the compression residual strain is large and permanent set is caused, cushioning characteristics for a long period of time is deteriorated, which is not preferable.

Water Absorption Ratio (1) At a water pressure of 10 cm and in an atmosphere of 50° C., a weight of the specimen sample after 24 hours was measured, and an increase in weight was indicated in a form According to the above-mentioned test results, the followings can be understood. That is, the polyurethane foam of Example 1 has a contact angle with water of 98°, a water absorption ratio of the foam of 1%, and a water-swelling ratio due to water of 0.2%, the water absorption ratio and the water-swelling ratio being extremely low. Further, a restoration elasticity thereof is 2.5%, which represents that stress dispersibility at the time of initial compression is excellent, so the polyurethane foam according to Example 1 is suitable for the cushioning material for a polishing pad.

Further, it can be understood that the polyurethane foam according to Example 2 has a contact angle with water of 98°, a water absorption ratio of the foam of 0.9%, and a water-swelling ratio due to water of 0.1%, the water absorption ratio and the water-swelling ratio being extremely low. Further, a restoration elasticity thereof is 2.8%, which is better than that of Example 1 and which represents that stress dispersibility at the time of initial compression is excellent, so the polyurethane foam according to Example 2 is suitable for the cushioning material for a polishing pad.

In contrast, the polyurethane foam according to Comparative Example 1 has a contact angle with water of 86°, a water absorption ratio of 10 wt %, and a water-swelling ratio of 0.6%, the water absorption ratio and the water-swelling ratio being high. Further, a restoration elasticity thereof is 1.8%, so the polyurethane foam of Comparative Example 1 is inferior to those of Examples 1 and 2. The polyurethane foam according to Comparative Example 3 has a contact angle with water of 81°, a water absorption ratio of 52 wt %, and a water-swelling ratio of 0.9%, the water absorption ratio and the water-swelling ratio being high. Further, a restoration elasticity thereof is 1.6%, so the polyurethane foam of Comparative Example 3 is inferior to those of Examples 1 and 2. The polyurethane foam according to Comparative Example 2 has a contact angle with water of 84°, a water absorption ratio of 39 wt %, and a water-swelling ratio of 0.7%, the water absorption ratio and the water-swelling ratio being high, so the polyurethane foam of Comparative Example 2 is inferior to those of Examples 1 and 2. However, a restoration elasticity thereof is 2.6%, which is a high value, thereby comparing favorably with Examples 1 and 2. While the foam is the polyether-based foam, the restoration elasticity exhibited is at a level corresponding to that of Example 1. This is probably attributed to a fact that a crosslinking density is reduced.

Further, as a matter of course, the results show that the polyurethane foam integrated with a PET film is further improved in its water absorption ratio.

Note that, the above embodiment and examples are not provided for limiting the present invention. According to the present invention, various modifications are possible without departing from the gist of the present invention.

What is claimed is:

1. A cushioning material for a polishing pad, the cushioning material comprising a foam body being formed in a sheet shape with a self-skin at least at one surface and a polyethylene terephthalate (PET) film integrally formed on another surface to provide a sheet shaped foam body with an upper surface for contact with a hard material surface layer and an opposite lower surface, the foam body being formed of a polyurethane foam having a contact angle with water of 90° or more, the polyurethane foam being obtained by reacting hydrophobic dimer acid polyester polyol and polyisocyanate with each other, wherein the polyurethane foam is foamed and cured in a heated oven to obtain the polyurethane foam body in a sheet shape formed with the self-skin, said polyurethane foam being integrated with a PET film by covering the another surface with a PET film which is not subjected to removal, wherein a distance between said upper surface and said lower surface provides a thickness of 0.5 to 2 mm with said foam body having a density of 300 to 700 kg/m$^3$.

2. A polishing pad comprising:

a hard material surface layer; and a cushioning material comprising a foam body being formed in a sheet shape with a self skin at least at one surface and a PET film integrally formed on another surface to provide a sheet shaped foam body with an upper surface for contact with the hard material surface layer and an opposite lower surface, the foam body being formed of a polyurethane foam having a contact angle with water of 90° or more, which is obtained by reacting hydrophobic dimer acid polyester polyol and polyisocyanate with each other, wherein the polyurethane foam is foamed and cured in a heated oven to obtain the polyurethane foam body in a sheet shape formed with the self-skin, said polyurethane foam being integrated with a PET film by covering the another surface with a PET film which is not subjected to removal, wherein a distance between said upper surface and said lower surface provides a thickness of 0.5 to 2 mm with said foam body having a density of 300 to 700 kg/m$^3$.

3. A cushioning material for a polishing pad, the cushioning material comprising a foam body being formed in a sheet shape with a self-skin at least at one surface and a PET film integrally formed on another surface to provide a sheet shaped foam body with an upper surface for contact with a hard material surface layer and an opposite lower surface, the foam body being formed of a polyurethane foam having a contact angle with water of 90° or more, the polyurethane foam being obtained by reacting hydrophobic dimer acid polyester polyol and polyisocyanate with each other, wherein the polyurethane foam is foamed and cured in a heated oven to obtain the polyurethane foam body in a sheet shape formed with the self-skin, said polyurethane foam being integrated with a PET film by covering the another surface with a PET film which is not subjected to removal, wherein a distance between said upper surface and said lower surface provides a thickness of 0.5 to 2 mm with said foam body having a density of 300 to 700 kg/m$^3$, said foam body having a 25% compression residual strain of 10% or less and a 25% compression stress of 0.3 to 0.7 MPa.

4. A polishing pad comprising:

a hard material surface layer; and a cushioning material comprising a foam body being formed in a sheet shape with a self skin at least one surface and a PET film integrally formed on another surface to provide a sheet shaped foam body with an upper surface for contact with the hard material surface layer and an opposite lower surface, the foam body being formed of a polyurethane foam having a contact angle with water of 90° or more, which is obtained by reacting hydrophobic dimer acid polyester polyol and polyisocyanate with each other, wherein the polyurethane foam is foamed and cured in a heated oven to obtain the polyurethane foam body in a sheet shape formed with the self-skin, said polyurethane foam being integrated with a PET film by covering the another surface with a PET film which is not subjected to removal, wherein a distance between said upper surface and said lower surface provides a thickness of 0.5 to 2 mm with said foam body having a density of 300 to 700 kg/m$^3$, said foam body having a 25% compression residual strain of 10% or less and a 25% compression stress of 0.3 to 0.7 Mpa.

* * * * *